United States Patent [19]

Strub et al.

[11] Patent Number: 4,914,893

[45] Date of Patent: Apr. 10, 1990

[54] LARGE SIZE CONTAINER BANDING APPARATUS

[76] Inventors: Eric W. Strub, 235 Rockhill Rd., Vista, Calif. 92038; Kenneth M. Strub, 25670 Gesmond Dene, Escondido, Calif. 92025

[21] Appl. No.: 160,848

[22] Filed: Feb. 26, 1988

[51] Int. Cl.[4] ..... B65B 9/10

[52] U.S. Cl. ..... 53/567; 53/585; 53/292; 53/557

[58] Field of Search ..... 53/567, 585, 291, 292, 53/293, 298, 557

[56] References Cited

U.S. PATENT DOCUMENTS

| | | | |
|---|---|---|---|
| 2,579,453 | 12/1951 | Allen et al. | 226/80 |
| 2,623,673 | 12/1952 | Holstein | 226/80 |
| 2,751,735 | 6/1956 | Bartlett et al. | 53/292 |
| 2,760,321 | 8/1956 | Greer et al. | 53/292 |
| 2,771,725 | 11/1956 | Carter | 53/41 |
| 2,787,104 | 4/1957 | Carter | 53/292 |
| 2,846,835 | 8/1958 | Aguilar et al. | 53/291 |
| 3,457,843 | 7/1969 | Bower | 93/53 |
| 3,509,684 | 5/1970 | Hohl et al. | 53/48 |
| 3,599,975 | 7/1971 | Abrecht | 53/291 X |
| 3,714,756 | 2/1973 | MacInnes et al. | 53/48 |
| 3,802,152 | 4/1974 | Strub | 53/64 |
| 3,812,642 | 5/1974 | Mintz | 53/567 X |
| 4,078,363 | 3/1978 | Ranzi | 53/228 |
| 4,102,728 | 7/1978 | Smith | 53/291 X |
| 4,354,333 | 10/1982 | McArdle | 53/48 |
| 4,412,876 | 11/1983 | Lerner | 53/585 X |
| 4,446,616 | 5/1984 | Waterman | 29/775 |
| 4,530,198 | 7/1985 | Le Bras | 53/48 |
| 4,545,181 | 10/1985 | Frankefort | 53/459 |
| 4,562,688 | 1/1986 | Mueller | 53/585 X |
| 4,649,697 | 3/1987 | Konstantin | 53/585 |
| 4,730,437 | 3/1988 | Benno | 53/585 X |

FOREIGN PATENT DOCUMENTS 1561973 3/1980 United Kingdom .

*Primary Examiner*—John Sipos

*Attorney, Agent, or Firm*—Brown, Martin, Haller & McClain

[57] ABSTRACT

A banding apparatus for automatically forming bands from flattened tubular banding material and applying them to large sized containers. A set of inner crease rollers disposed on a floating wedge inside the tubing interact with outer crease rollers to press out sidewall creases during formation of cylindrically shaped bands. The wedge comprises a pair of parabolic or variable width separation plates joined at right angles along a common axis and using a mounting block to support the inner crease rollers. A feed assembly in the form of a reciprocating slide assembly releasably engages the banding material using a contact lever and advances predetermined lengths of the banding material to a cut-off assembly above the containers where they are cut into separate bands. A support head positioned adjacent to the cut-off assembly engages and holds a portion of each band in a fixed vertical position above the containers which suspends them in an open configuration for engagement by individual containers. A retention element is mounted on an opposite side of the banding material from the support head and holds the banding material in a collapsed state against the head until the banding material is cut into a band. The retention element is retracted above the bands, once formed, thereby allowing them to open next to an upper portion of a container for engaging the container. A transport mechanism includes a secondary heat source and deflection elements for contracting portions of the bands prior to main heat treatment.

26 Claims, 8 Drawing Sheets

FIG. 15
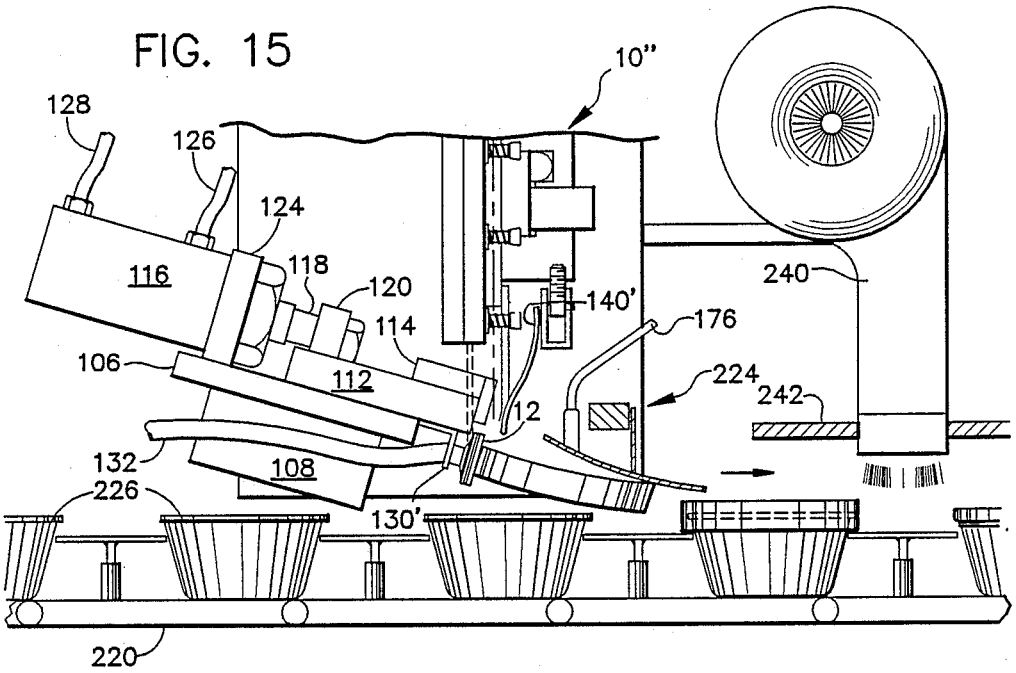
FIG. 16
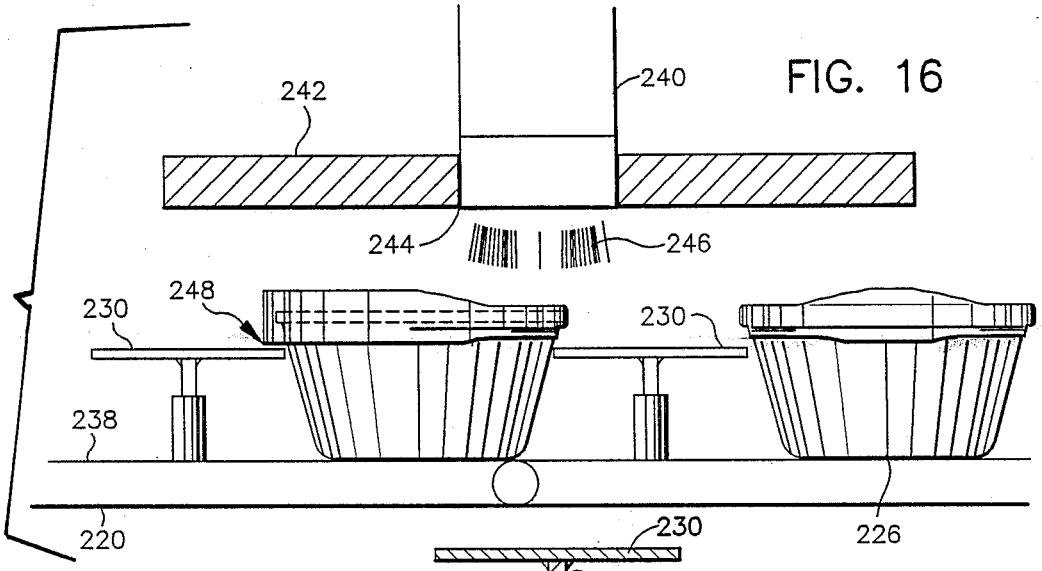
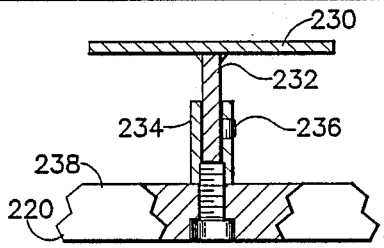
FIG. 17

LARGE SIZE CONTAINER BANDING APPARATUS

BACKGROUND OF THE INVENTION

1. Field of the Invention

The present invention relates to apparatus for placing bands on containers and more particularly to an apparatus for automatically forming and positioning a band about the periphery of large sized containers. The invention further relates to a method and apparatus for more efficiently forming open cylindrical bands from continuous lengths of banding material.

2. Backqround of the Art

Several machines and devices have been developed for cutting and mounting bands of shrinkable materials onto a variety of containers for sealing the containers. While other materials have been used, a preferred material is a thermosetting plastic which is typically fed as continuous lengths into a machine where it is cut into separate cylindrical bands, deposited on target containers, and subsequently contracted through the application of heat to form a tightly fitting seal.

Examples of machines for cutting and mounting heat shrinkable plastic bands are found in U.S. Pat. Nos. 2,623,673, and 2,751,735 and my earlier U.S. Pat. No. 3,802,152. These machines show a variety of mechanisms for receiving plastic tubing material and cutting it into small bands for application to small bottles. In each of these machines the target container rests in a fixed alignment position and the newly formed band is transported to a container where it is deposited over an upper neck or cap portion.

Bands formed and applied in this manner provide a safety seal and often improve container appearance and marketability. Instructions or labeling information can also be imprinted on the bands, which can be made to encircle large portions of the target container in addition to the neck or cap.

Unfortunately, most large size or scale containers of interest have container diameters or perimeters much larger than that accommodated by current banding apparatus designs as exemplified by the above referenced patents. The large, and often irregular, shapes required for large scale containers preclude the use of simple, circularly symmetric or cylindrical, band transport mechanisms adjacent to the containers. Larger "rings" or bands of thin plastic material are not rigid enough to be easily moved or transferred by mechanical means onto containers and tend to collapse before they can be placed on the containers. It is generally believed that very complicated and large apparatus would be required for handling such tasks which would prove unreliable and costly to implement.

In addition, there are many new banding applications requiring the use of bands on containers having lids or tops that are wider or larger in diameter than the remainder of the container. Unlike prior applications, where a wider lower portion of a container could be used to hold the band until shrunk, these bands simply fall to the bottom of the container. To counter this it was believed that complicated apparatus was needed.

Therefore, what is needed is a machine or apparatus capable of automatically placing a large diameter sealing or joining band of shrinkable material around the outside of a substantial portion of large containers. It is desirable that any such apparatus be designed to handle a variety of container or object types and sizes and to efficiently handle flattened banding material. It would be highly advantageous if the banding apparatus accommodated containers having larger lids, tops or mouths, than the remainder of the container without requiring unduly complex apparatus.

SUMMARY OF THE INvENTION

With the above problems and disadvantages of the prior art in mind, one purpose of the present invention is to provide a machine for automatically banding large size containers.

Another purpose of the present invention is to provide a machine which more efficiently opens and forms flattened banding material stock during the banding process.

It is an advantage of the present invention that it can accommodate large containers or objects automatically using continuous banding material stock.

Another advantage of the present invention is that it accommodates large containers or objects at high throughput rates.

These and other purposes, objects, and advantages, of the present invention are realized in a banding apparatus for automatically applying a single band to large sized containers comprising forming means for receiving and opening flattened tubular banding material, pressing out creases in a sidewall of the banding material, and forming cylindrically shaped bands of predetermined diameter and height. The circumference of the formed bands is larger by a predetermined contraction length than a perimeter length around the target containers. A feed assembly is positioned adjacent to the forming means and engages the banding material and advances predetermined lengths of the banding material, at variable rates, from the forming means to a position vertically adjacent to the target containers. A cut-off assembly disposed above the containers cuts predetermined lengths of banding material from the desired separate bands. A suspension means positioned adjacent to the forming means receives the bands by engaging and holding a portion of the band sidewall in a fixed vertical position above the containers which suspends each band in an open configuration for engagement by individual containers.

In further aspects of the invention, the band forming means comprises an input guide roller mounted transverse to the travel path of the banding material, at least two outer pinch rollers rotatably mounted one each on a support bracket adjacent to the path, each outer pinch roller positioned to rotate against the banding material, and a floating wedge disposed within the hollow interior of the tubular banding material. The wedge is wider than the space between the outer pinch rollers and has at least two inner pinch rollers positioned for rotatably engaging interior surfaces of the banding material, and is positioned within the banding material so that the inner rollers are immediately adjacent the outer rollers so as to flatten creases in-between.

The floating wedge further comprises first and second substantially flat separation plates, each having a narrow end and a wide end, with a central axis extending therebetween, to assist in gradually spreading the wall of the flattened tubing material open. A substantially parabolic shape is preferred with the widest part of each plate being on the order of one-half the circumference of the banding material. The plates are joined together at their narrow ends along their respective central axis so that they are substantially perpendicular to each other and joined so that the narrow end of the first plate overlaps the narrow end of the second plate by a predetermined distance. The inner crease rollers are disposed adjacent to the narrow end of one of the plates with one roller along each outer edge of the plate. The inner crease rollers are typically mounted on a rectangular support block which has two substantially parallel faces and four sides with a central slot disposed between the faces. The support block slot fits over the narrow end of the plate holding the inner crease rollers and is wider than the separation plate is thick, with the inner crease rollers mounted within depressions on the sides of the support block.

An alternative floating wedge is easily manufactured from a tetrahedron shaped block with at least two inner crease rollers disposed on two opposing faces of the block adjacent an apex thereof.

The feed assembly comprises a slide assembly mounted in the travel path for the banding material which is vertically movable parallel to the path in downward and upward feed strokes. The slide assembly has a slot for passage of the banding material and is connected to a feed piston rod which is in turn connected to a cylinder connected to provide reciprocating vertical movement. A contact lever, in the form of an inverted L shaped lever, is pivotally mounted on the slide assembly. The contact lever has vertical and horizontal legs and is mounted so that it pivots about the intersection the two legs with the vertical leg extending through a slot in the assembly for contacting the banding material and the horizontal leg extending away from the banding material. The horizontal leg is positioned for releasable engagement by the piston rod whereby the contact lever achieves clamping engagement of the banding material on each downward stroke for moving the banding material through the feed means and substantial non-clamping engagement of the banding material on each upward stroke.

In a preferred embodiment, the feed piston rod engages the slide assembly and contact lever by using a C or U shaped engagement bracket secured to the lower end of the piston rod. The engagement bracket is configured to engage the slide assembly above and below the horizontal lever and to releasably engage the lever on downward strokes.

The cut-off assembly comprises a reciprocating blade assembly disposed across the travel path for the banding material and positioned at a downward angle so that a cut-off blade slidably engages the banding material at an angle against a shear stop plate. An input plate secured to a top portion of the blade assembly has a guide slot formed in the plate and positioned transverse to the travel path to guide the banding material through the slot and into the blade assembly.

The suspension means comprises a support head mounted adjacent to an output of the cut-off assembly in order to be immediately adjacent to the banding material while it is being cut into newly formed bands. The support head is configured as a flared nozzle coupled through hollow tubing to a source of negative pressure. In a preferred embodiment, the nozzle is secured to a support bracket mounted to an underside surface of the blade assembly adjacent the travel path for the banding material.

The banding apparatus further comprises a retention means mounted on an opposite side of the banding material from the suspension means for releasably holding the banding material in a collapsed state against the suspension means. The retention means is vertically movable between an engaged position adjacent to the suspension means so as to hold banding material in a collapsed state against the suspension means and a retracted position above both the suspension means and the bands, allowing each band to open next to an upper portion of a container for engaging the container.

A preferred retention means comprises an elongated retention clip secured on an upper end to the slide assembly of the feed assembly for raising or lowering in coordination with the upward and downward strokes respectively of the slide assembly. The retention clip extends vertically downward toward the suspension means substantially parallel to the travel path of the banding material. A lower end of the retention clip is biased to engage the cut-off assembly adjacent the banding material when the slide assembly is in an up-stroke position and engage the banding material on an opposite side from the suspension means when the slide assembly is in a down-stroke position.

An alternate retention means comprises a retention bar having a longitudinal axis positioned substantially perpendicular to the travel path and a vertical driver connected to the retention bar for raising or lowering the retention bar in coordination with the upward and downward strokes respectively of the feed means. The vertical driver typically comprises a first vertical rod connected to the retention bar on a lower end and extending upward toward the feed means where it is connected on an upper end through a horizontal bracket to a second vertical rod. The second vertical rod is coupled to the feed means piston rod, generally by a second horizontal bracket, and causes up or down movement.

The banding apparatus further comprises a transport means for moving containers or objects into or out of the banding apparatus and an alignment device for positioning each successive ones of the containers within a volume encompassed by a suspended band.

When applying bands to containers having main or lower lateral body dimensions equal to or smaller than a larger top or lid portion, the bands are disposed about the containers at a preselected vertical height next to a lid or top to be sealed and supported there while a small portion on opposite sides of the container are heated so as to contract and hold the band in place.

This procedure is accomplished using a transport mechanism such as a segmented conveyer belt for supporting and moving containers under a band mounting station and then to a heat tunnel. A heat source is mounted adjacent to the mounting station, and provides a heated air stream which is directed downward over a portion of a transport path for the containers. A deflection means in the form of a plurality of spaced apart deflection plates are disposed above the transport mechanism and direct the air stream onto a predetermined portion of a leading and trailing side of each container which causes contraction of a portion of the band on these sides of each container.

A vertical support element is disposed between the transport mechanism and the deflection plates for adjustably holding the plates at selected heights to position the plates, and thus a bottom edge of the bands, a predetermined distance from the top of each container. In a preferred embodiment, the vertical support element comprises at least one telescopic post and tubing assembly connected on one end to the deflection plate and on a second end to a segmented conveyer belt, with a retention element, such as a set-screw, connected between the post and tube to secure a fixed vertical extension distance of the post from the tube.

BRIEF DESCRIPTION OF THE DRAWINGS

The novel features of the present invention may be better understood from the accompanying description when taken in conjunction with the accompanying drawings in which like characters refer to like parts and in which:

FIG. 15 illustrates a front view of a large container bander employing a transport mechanism constructed according to the principles of the present invention;

FIG. 16 is an enlarged front elevation view of a portion of the transport mechanism of FIG. 15 with the heat source operating; and FIG. 17 is an enlarged cross section of a deflection plate assembly of the transport mechanism of FIG. 15.

DETAILED DESCRIPTION OF A PREFERRED EMBODIMENT

The present invention provides a method and apparatus for forming discrete bands from continuous lengths of banding sleeve material and applying the bands to containers, packages, or solid objects. The present invention accomplishes this by first forming bands large enough to fit around the containers of interest from a continuous roll of shrinkable banding material and then supporting the bands in an open position over a mounting station. A transport mechanism delivers containers serially to the mounting station where they automatically engage the bands and are then transferred by the transport mechanism to a shrinking stage.

Figure 1:
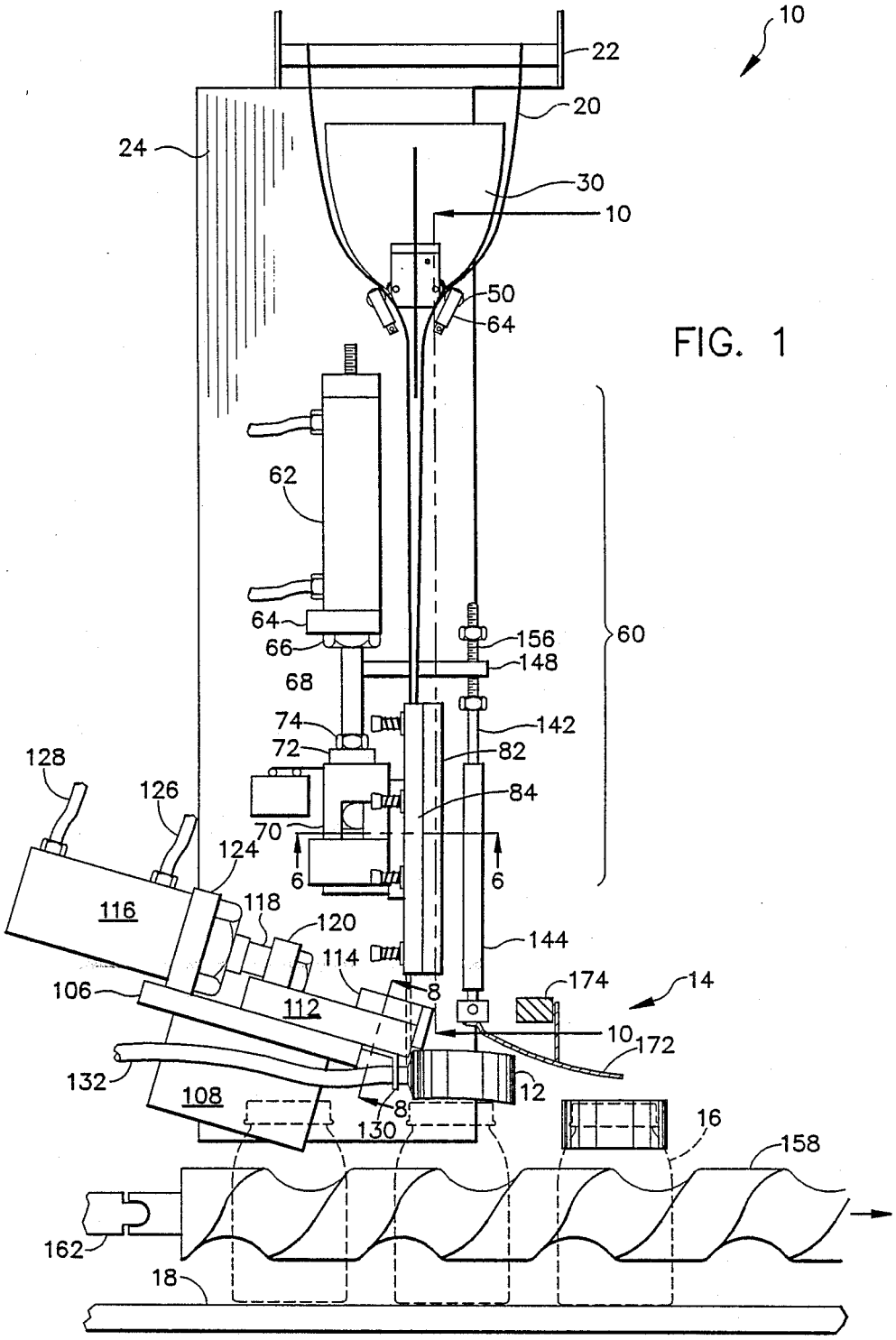
FIG. 1 illustrates a front elevation view of a large container bander constructed according to the principles of the present invention.

An apparatus for banding or sealing large sized containers or containerized goods according to the principles of the present invention is illustrated in a front elevation view in FIG. 1. In FIG. 1, a large container bander 10 comprises an upper band forming section for receiving stock tubing material and cutting and otherwise forming it into a series of bands 12 and a band deposition station 14 where the bands are fitted onto a series of containers 16. A container transport system 18 transfers containers from a packing source or other location into the bander 10 where they are aligned with the bands.

The containers being banded in the illustrated embodiment can comprise any of a variety of bottles or bottle types (screw top, cork seal, pry cap, etc.), small boxes, or reasonably rigid objects depending upon the specific product the apparatus user wants to work with. The only limitations are the chosen dimensions of the transport mechanisms and banding material, and any limitations as to exposure of the objects or containers to heat when thermoplastic banding material is employed. The term "containers" is used throughout as an exemplary label for items capable of being surrounded by a band and is not limited to a single type of "bottle" per se. A bottle shape is used for ease and clarity of illustration in showing the advantages of the present invention and in addressing a long felt need in the packaging industry.

The container transport system 18 generally comprises a conveyer belt which moves containers 16 in serial fashion at a predetermined rate to the banding station 16. Both multi-segment and continuous material (chain, plastic, rubber, etc.) conveyer belts and associated drive and support apparatus are well known in the mechanical arts and are not described in further detail here.

As in previous banding apparatus, the containers 16 are positioned under an appropriate band 12 which is released or otherwise deposited onto the containers. The present invention is intended for use with a variety of containers but it is contemplated that many applications involve containers having dimensions on the order of 2 to 4 inches or more in diameter for round or oval cross sections, or on a side for square cross sections. These dimensions require bands on the order of 4–13 or more inches in circumference.

Since the band material lacks a rigid structure, it is very difficult to move bands this large any distance without unduly complex apparatus which decreases speed and reliability, while at the same time increasing cost. Therefore, the use of previously disclosed cylindrical guide and piston structures to hold and move such large bands, is generally impractical or prohibitive. To avoid these problems and operate more efficiently, the large container bander 10 of the present invention, takes advantage of the flexible nature of the cut bands to support each band in an open configuration and move a container 16 into the band. This also permits the use of an assortment of band or container sizes without total or customized retooling of the apparatus 10 or associated band transport apparatus as would be required by earlier designs.

The bander 10 is shown with banding material 20 entering the bander 10 from an external supply reel (not shown), which is generally mounted on a rotating spindle supported adjacent to or on a rearward portion of the bander 10. The preferred use of bulk banding material, as opposed to a magazine of pre-cut bands, allows a continuous supply of bands without human intervention or complex feeding machinery, and ready change out of materials or preprinted band stock for a variety of containers.

The banding material 20 comprises one of a variety of heat shrinkable, thermoplastic materials known in the banding arts, such as polyvinylchloride (PVC). While other materials can be used, PVC is a preferred material because very thin layers provide high strength bands which are easily molded or contracted using a heat source at about 300 degrees Fahrenheit which does not readily damage most containers or goods contained inside. PVC material has also proven to be a good printing surface for information or instructions.

The plastic banding material 20 is generally supplied in the form of a very tightly packed and compact tubular material having a variety of dimensions from about 1 to 8 inches or more in diameter. The tight packing of the material 20 onto a roll results in the outer edges of the material being crimped or formed into a continuous crease. This crease tends to force the tubing sides to collapse or close on themselves which does not lend itself to depositing the band around a series of containers. Therefore, as disclosed in my earlier invention of U.S. Pat. No. 3,802,152, which is incorporated herein by reference, a forming assembly is employed to alter the "memory" of the banding material 20 along any creases during formation of the individual bands 12 so that the bands remain open for deposition on containers.

As shown in the FIG. 1, the banding material 20 passes over one or more guide rollers 22 positioned adjacent to the the top of the bander 10 for directing the movement of the banding material 20 downward towards a cutting blade assembly. Such rollers are slightly longer (or wider) than the width of the flattened tubing material 20 which is at least as wide as one half the peripheral dimensions needed to clear the chosen containers 16 (plus contraction amount).

The bander 10 typically has a back or support wall 24 which is used to hold or support many of the mechanical elements used in forming the bands 12 including the guide roller 22. While other structures can be employed, a vertical support wall in the form of a 0.375 to 0.5 inch metal plate, such as aluminum, allows the various elements and support brackets to be secured to a rigid surface and yet be easily readjusted as maintenance or alternate banding material 20 sizes demand. In addition, this support wall can be mounted on a series of support posts or brackets 26 which allows fine adjustment of the wall position.

A free floating separation wedge or wedge assembly 30 is inserted into the hollow interior of the plastic (tubing) banding material 20, to open the flattened wall and separate the interior wall surfaces of the tubing. This prepares the banding material edges for "counter-folding". Counter-folding is a method of reversing the fold or crease along the edges of the plastic material 20 so that it does not tend to collapse the open tubing, at least temporarily. To accomplish counter folding the wedge 30 uses at least two interior pinch rollers which interact with opposing exterior pinch rollers to press the crease.

Figure 2:
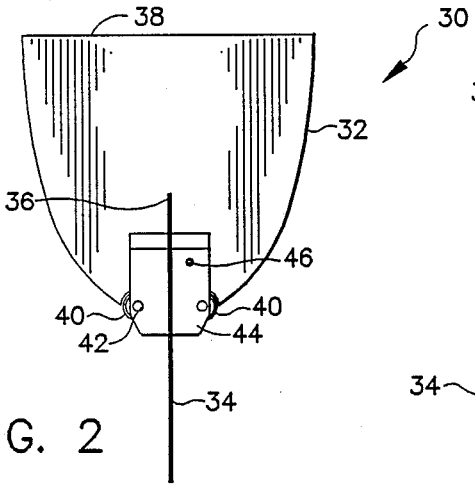
FIG. 2 illustrates an enlarged front elevation view of a separation wedge used in the bander of FIG. 1.
Figure 3:
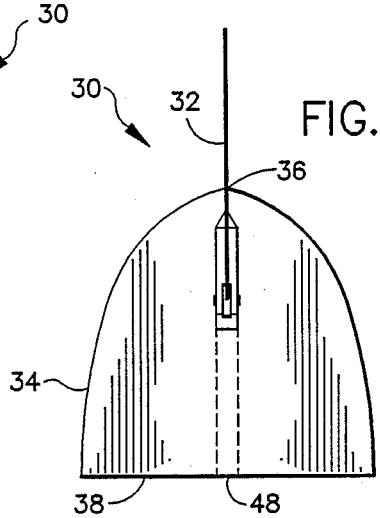
FIG. 3 is a side elevation view of the separation wedge of FIG. 3.

The construction details of an exemplary wedge assembly 30 are illustrated in further detail in the side views of FIGS. 2 and 3. In FIG. 2, the wedge 30 is shown comprising two substantially flat plates 32 and 34 which are joined together using means such as, but not limited to, spot welding, soldering, or adhesive bonding along an intersection line or joint 36. However, for some embodiments, such as for short lengths that do not readily warp, these plates can be can be secured together by friction fitting.

In the preferred embodiment, the plates 32 and 34 comprise thin aluminum or stainless steel plates on the order of 0.030 to 0.0625 inches thick, although other materials and dimensions can be employed. It is desirable to maintain a thin profile and minimal weight while providing a material that will withstand long term exposure to surface abrasion.

The plates 32 and 34 are each configured with a wedge like profile to open and expand the banding material 20. That is, each plate starts on one end or edge as a narrow or pointed end and expands outward along side edges to a much wider end or edge. As stated, the widest end of the plates 32 and 34 is made approximately the same width as one half the circumference of the banding material 20. The narrow end can be made as small as desired. A variety of shapes can be used including, but not limited to, triangular, frustrated triangular, or even exponential. A preferred shape is a generally parabolic shape starting from a narrow inner point and terminating in a straight outer edge 38.

It has been found desirable to be able to adjust the size of the plates 32 and 34, or the overall width of the wedge 30 for varying sizes of banding material 20, as well as for variations in the surface adhesion of the plastic material 20. To accomplish this, the plates or fins 32 and 34 are made replaceable with smaller or larger plates so that the widest portion of the wedge 30 is adjusted for corresponding changes in the circumference or diameter of the banding material 20.

As seen in FIG. 2, the wedge assembly 30 employs at least two interior or inside pinch rollers 40, mounted on shafts or pins 42 along the sides of a support block 44. The pinch rollers 40 rest in recesses in the sides of the block 44 with a small portion extending beyond the sides of the block for contacting the interior of the banding material 20.

The block 44 comprises a rectangular plate or block of material having flat front and back surfaces and formed from material such as aluminum which is lightweight but offers strong support for the rollers 40. The block 44 has beveled or slanted edges where it may encounter the banding material 20 to reduce drag. In addition, the block 44 has a large slot centrally located between the front and back surfaces which allows the block to slide over the plate 32 (or the plate to slide into the block). Once mounted, the block 44 is retained in position by friction or one or more set screws 46.

In order to mount the block 44 in place, the plate 34 has an elongated passage or opening 48 adjacent to the narrowed inner end or point on the intersection line 36, through which the block is laterally inserted before being positioned over the plate 32. The passage 48 needs to extend along the plate 34 a distance equal to or greater than the length of the block 44, when measured from the end of the plate 32. However, for fairly short wedge structures the passage 48 can be extended to the outer end of the plate 34, as shown by the dashed lines in FIG. 3. This allows both short and long plates to be used with a single block 44, thus, minimizing readjustment of associated support rollers.

Figure 4:
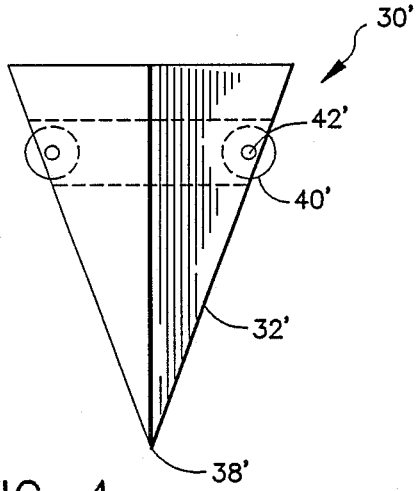
FIG. 4 is an enlarged front elevation view of an alternate separation wedge for use in the bander of FIG. 1.
Figure 5:
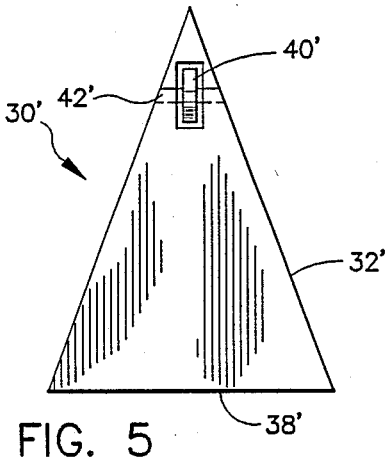
FIG. 5 is a side elevation view of the alternate separation wedge of FIG. 4.
Figure 6:
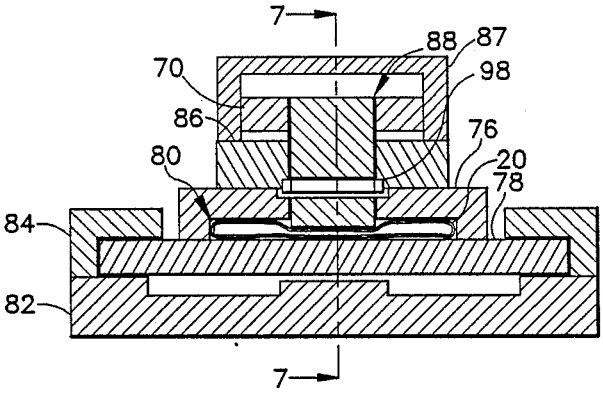
FIG. 6 is an enlarged end sectional view of the feed mechanism used in the apparatus of FIG. 1 taken on line 6—6 of FIG. 1.

An alternate wedge design is illustrated in FIGS. 4 and 5. In these figures, a tetrahedral shaped wedge block 30' is used. The block 30' typically comprises a material such as stainless steel and is used for smaller tubing material 20 sizes. A pair of inner crease rollers 40' are mounted in recesses on opposite sides of the block 30' near one end. The block 30' and the recess or passage used for the rollers 40' can be formed using techniques such as wire saw cutting.

The interior crease rollers allow the material 20 to pass over the wedge 30 or 30' without undue friction or binding. The wedge 30 in effect rolls along the inside of the tubular banding material 20 except for a small amount of surface contact with the plates 32 and 34, or block 30', and associated hardware around the rollers 40, or 40'.

As shown in the front view of FIG. 1, matching exterior pinch rollers 50 are mounted on shafts or axles 52 in roller support brackets 54. The rollers 50 are rotatable about an axis transverse to the banding material path. The rollers 50 generally include bearings and are rotatable about the shafts 52 which are rigidly mounted at their inner ends within suitable openings provided in the support brackets 54. The opposite or outer ends of the shafts 52 each carry a retaining fitting seated within a peripheral end groove to retain the respective roller on its shaft. Each roller bracket 54 is mounted by screws 56 or similar fasteners to the support wall 24. By loosening one or both of the screws 56 the associated brackets can be rotated about the axis of the screws to locate the shafts 52 closer or farther apart.

The exterior pinch rollers 50 are positioned to extend upward from the brackets 54 so that they support the wedge 30. The wedge 30, which has a width wider than the space between the rollers 50, rolls or slides downward under gravity and presses down on the rollers 50. Since the width of the wedge closely approximates the diameter of the tubing material 20, this presses the crease open while the material 20 opens or expands and passes over the wedge 30.

The cylindrical interior rollers 40 force the wall of the banding material 20 flat against the sides of the exterior pinch rollers 50. This temporarily flattens the fold or crease on the banding material 20 and the creased edges are pressed out. During the short length of time it takes for the plastic banding material 20 to travel from the wedge 30 to the remainder of the bander 10, the crease has a tendency toward expanding or folding open and the banding material tends to assume a cylindrical configuration.

As seen in the front view of FIG. 1, the banding material 20 is fed or threaded over the guide roller 22 between the rollers 40 and 50 to a feed mechanism 60. The feed mechanism 60 pulls on the banding material 20 and moves the material 20 into a cutting assembly 100 positioned below the feed mechanism.

The feed mechanism 60 generally comprises a double acting or bi-directional cylinder 62 which is mounted on a lower end to a cylinder support bracket 64. This can be accomplished using a threaded nut 66 which secures a threaded projection on the end of the cylinder 60 into a matching hole in the bracket 64. The bracket 64 is secured to the support wall 24 by means such as screws or bolts through the support wall and into the end of the bracket 64 or through flanges formed in the end of the bracket 64.

A piston rod 68 extends downward from the cylinder 62 where it is connected on an upper end to a piston that slides within the cylinder. An exemplary air cylinder 62 also provides for adjustment of the relative position or maximum extension of the piston rod 68 using an adjustment bolt or threaded rod assembly secured to the upper end of the piston and cylinder 62.

Figure 7:
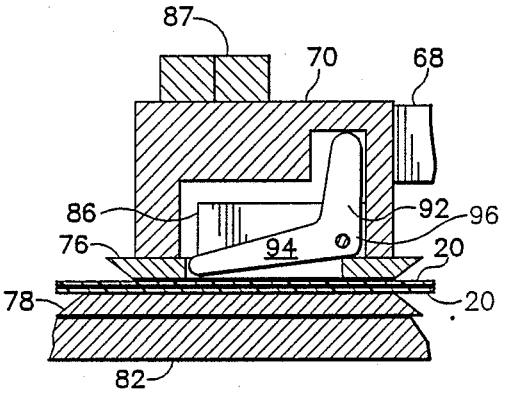
FIG. 7 is a side sectional view taken on line 7—7 of FIG. 6.

A generally C or U-shaped driver bracket 70 having upper and lower legs or leg extensions, is mounted on a lower end of the piston rod 68, as seen in FIGS. 1 and 7. A central portion of the bracket 70 has a depression or slot for confining and interacting with a contact lever arm, as discussed below. The drive bracket 70 is positioned adjacent to a slide block 76 which is slightly higher than the separation between the legs of the bracket 70. The bracket 70 does not interconnect with the slide block 76 although it can where desired.

In the preferred embodiment, the piston rod 68 has a threaded end portion which is secured in a threaded hole in the driver bracket 70. However, other means such as press fit pins or set screws can be employed to secure this attachment. In addition, a contact plate 72 is secured to an upper portion or the top of the driver bracket 70 using a nut 74 disposed about the threaded piston rod 68. Again, separate bolt or machine screw fasteners can be used to join the contact plate 72 to the bracket 70 where desired.

The slide block 76 is secured to a slide plate 78 by fasteners such as a plurality of machine screws countersunk through holes in the block 76. As best viewed in FIG. 7, the upper and lower edges of the slide block 76 and plate 78 are slanted or sloped to facilitate insertion and passage of the banding material 20 between the drive block 76 and the slide plate 78. The banding material 20 moves downward through a vertically extending channel or slot 80 formed in the drive block 76. The channel 80, in conjunction with an adjacent face of slide plate 78, forms an enclosed guideway or passage for the banding material 20, which directs it downward toward a cut-off blade assembly 100.

The slide block 76 and slide plate 78 constitute a slide assembly which slides vertically over the face of a fixed vertically extending slide support plate 82 which is attached along one vertical edge to the back support wall 24. A pair of guide rails 84, generally configured as L shaped channels or plates having channels formed on one side, are secured to one face of the plate 82 along a pair of parallel vertical edges. Each guide rail has an overlying flange or channel edge which bears against an adjacent edge of the slide plate 78. The guide rails 84 have openings through which fasteners such as Allen head screws, are secured to the channel plate 82. Compression springs are disposed about the screws, between the heads, or washers, and the guide rails so that the rails are flexibly biased against the slide plate 78.

A pivot block 86 is secured to the back side of the slide block 76, between the driver bracket 70 and the slide block 76. The C-shaped drive bracket 70 is configured to accommodate the pivot block 86 between its upper and lower legs which are spaced apart slightly wider than the height of the block 86. The bracket 70 does not have continuous surface contact between both upper and lower sides of the pivot block 86 at the same time, but should be reasonably close to eliminate undue travel for the piston 68 before contact is made. The pivot block 86 is secured to the slide block 76 by fasteners such as a plurality of machine screws (not shown) counter sunk through holes in the block 86.

In order to provide a snug fit and decrease play which could lead to separation of the drive bracket 70 and the pivot block 86, a generally C or U-shaped guide block 87 is mounted on the surface of the pivot block 86 facing the drive bracket 70 and extends around a middle portion of the drive bracket. The guide block 87 acts to hold the drive bracket against or next to the pivot block 86 so that the legs of the bracket 70 contact the pivot block 86 on upward or downward strokes.

A contact lever or elbow 90 is mounted within a central slot 88 which extends through the pivot block 86, and the slide block 76. The elbow 90 comprises an L shaped or substantially right angled lever or bracket structure having an upper or horizontal arm 92 and a lower or vertical arm 94 extending outward from a central intersection corner 96. The elbow 90 is secured in place using a pivot pin 98 through a central portion of the corner 96 so that the elbow 90 rotates freely about the mid-point intersection of its two arms 92 and 94. The horizontal arm 92 extends out of the slot 88 above the top of the block 86.

When the feed bracket 70 is moved down by motion of the piston rod 68, the bracket 70 engages the upper, horizontal, arm 92 of the elbow 90 which is moved downward, causing the lower, vertical, arm 94 to pivot into engagement with the banding material 20 in the slot 80. When the driver bracket 70 is moved up, the elbow 90 is released and the lower arm 94 no longer presses against the banding material 20.

The banding material 20 passes through the slot 80 and is periodically engaged by the elbow arm 94 for downward advancement. That is, when the slide block 76 is located at the top of the plate 82, the cylinder 62 is actuated to extend the piston rod 68 downward. This action moves the pivot block 86, slide block 76, and the slide plate 78 downward with the banding material 20 clamped between them. At the bottom of the piston rod stroke or travel, the slide block 76 is located adjacent to the bottom of the support plate 82. At this point, an opposite actuation of the cylinder 62 then retracts the piston rod 68 and releases the clamping force of the elbow 90 on the banding material 20, so that the banding material does not move back up with the pivot block 86 and slide block 76. In this manner the feed assembly 60 advances banding material 20 a predetermined amount each time the cylinder 62 is actuated to extend the piston rod 68.

Actuation of the cylinder 62 is precisely controlled to occur at predetermined times and at predetermined rates. To this end, a series of one or more optical sensors can be used, especially where registration marks are available on the banding material, to determine if the banding material 20 is in the correct advanced position. Such sensors are disclosed in my previous U.S. Pat. No. 3,802,152 and not described here in detail. A plate or bracket can be used to secure such sensors in place adjacent to the path of travel for the banding material 20.

The feed assembly 60 advances the plastic banding material 20 into the cut-off assembly 100 where a reciprocating blade interacts with an associated shear stop to shear off or cut through the plastic material 20 at predetermined intervals.

Figure 8:
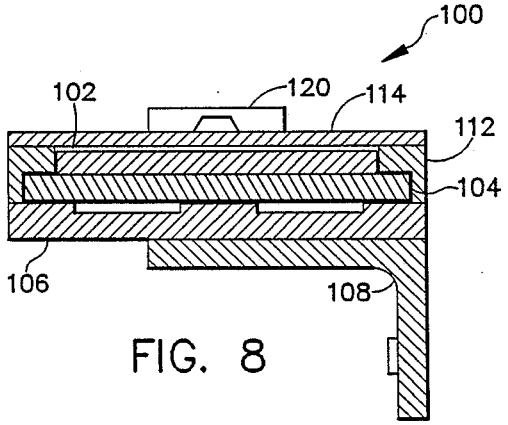
FIG. 8 is an end sectional view of the cutting mechanism used in the apparatus of FIG. 1 taken on line 8—8 of FIG. 1.
Figure 9:
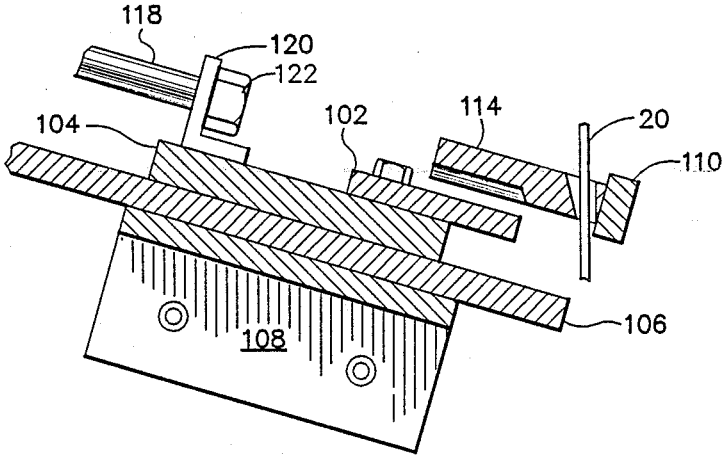
FIG. 9 is a side elevation view taken on line 9—9 of FIG. 8.

As illustrated in the sectional views of FIGS. 8 and 9, the cut-off assembly 100 has a blade 102 secured to a slide plate 104 which slidably rests on a support plate 106. The support plate is in turn secured to the support wall 24 using means such as a right angle support bracket 108. The support plate 106 is generally mounted at an angle to the travel path of the banding material 20 to improve cutting efficiency. The support plate 106 allows the blade 102 to slide back and forth toward the banding material 20 while maintaining a precise vertical position relative to a shear stop 110.

A pair of blade guide rails 112 are mounted along two horizontal edges for guiding the blade slide plate 104 in a reciprocating motion on the support plate 106. The rails 112 are secured in place on the support plate 106 by suitable fasteners (not shown) such as a series of counter sunk bolts. The guide rails 112 and support plate 106 are typically manufactured from high carbon heat treated tool steel or other high strength metals to resist the long term abrasion of continual blade motion.

The blade 102 comprises a flat plate of hard material such as, but not limited to, high carbon heat treated tool steel, that is removably fastened to the top surface of the slide plate 104 by fasteners such as screws or bolts. The blade 102 has a cutting leading edge that extends beyond the forward edge of the slide plate 104. The blade 102 generally has elongated slots for engaging fastening screws to allow for adjustment and positioning to obtain a precise cut. While a beveled leading edge can be used to improve the fineness of the cut, a square edge allows the blade 102 to be reversed to distribute wear on opposing edges to extend the life of the blade before servicing or replacement.

Where desired, the blade 102 includes a hemi-spherical, triangular or other form of depression from the top of the leading edge and along the face of the shear plate so as to form a corresponding tab in the bands.

To help support and guide the plastic material 20 through the blade assembly 100 so that a clean, sharp cut is achieved, one or more slotted guide plates 114 are positioned on top of the guide rail 112 adjacent to the end of travel for the blade 102 and the shear stop plate 110. The cut off blade 102 is slidable between the rails 112 and shears off the material 20 as it passes through the guide slot in the plate 112.

The blade 102 is moved back and forth in a quick and precise cutting stroke by a driver which is preferably a bi-directional or double acting air cylinder 116 connected to a piston rod 118. The piston rod 118 is connected to the slide plate 104 by a drive bracket 120 which can be attached to the slide plate 104 using bolts, screws or other fasteners. The end of the piston rod 118 engaging the plate 120 can be threaded to interface with a threaded hole in the bracket or allow fastening by a nut assembly 122.

The cylinder 116 is generally mounted on the support plate 106 using a cylinder bracket 124 and a nut 125 as before. Blade motion is controlled by adjusting the pressure delivered to the cylinder 116 through the supply lines 126 and 128 as discussed below.

Where desired, a series of one or more plates can be secured to the piston rod 118 or plate 104 to interact with switches or valves as part of a control system. Alternatively, the bracket 120 has an extension which provides this function. Small valves or switches are secured to the apparatus 10 housing or back support wall 24 adjacent to the support plate 108 and piston rod 118. If desired, a slot is formed in the wall 24 so that a contact plate extends through the wall to interact with valves mounted behind the wall. In addition, since the travel of the piston is predetermined by the size and placement of the elements described above, an automatic timer can be used to coordinate the advance and retraction of the blade 102.

The feed stroke of the feed assembly 60 moves a predetermined length of the banding material 20 through a slot in the upper material guide plate 114 where it is sequentially cut to form discrete bands 12. However, the bands 12 must be held open and deposited on or over the target containers. This procedure is accomplished using a new vacuum powered band suspension or positioning system.

In FIG. 1, a newly formed band 12 is shown positioned in front of a support head 130 which seizes the plastic material 20 and suspends it in a fixed location. The support head 130 comprises a relatively air tight nozzle mounted on a support bracket 132 from the bottom of the support plate 106. The nozzle or support head 130 is connected to an exit tube 134. The nozzle of the head 130 is maintained at a lower pressure than the surrounding atmosphere by connecting the exit tube 134 to an air or vacuum pump (not shown) which evacuates air from the tube. The exit tube 134 is typically connected through a manifold system and electrically operable valve to a vacuum or air pump for removing or pulling air so that a negative air pressure is created at the surface of the support head nozzle to hold bands against the nozzle.

As a band is cut, the air flow in the head 130 is activated and a portion of the outer surface of band 12 moves against the head 130. In order to provide a diffuse suction and distribute the pulling force over a larger portion of the band 12 surface and prevent crimping, the head 130 is flared to form a diffusion type tip.

As seen in FIG. 1, once a band 12 is supported by the head 130 on one side it opens out. Due to its size and lateral flexibility the band 12 extends laterally from a position above one side of the top of target containers to a position below the opposite side of the top of the containers. This means that containers engage a portion of the band 12 opposite from the side held by the support head 130 which further opens or extends the band and causes it to expand around or over the top of the target container 16. In addition, the head 130 can be angled downward along with the plate 104 to assure adequate engagement of the bands 12.

The low of air through the exit tube 134, and support head 130, is interruptable by the an automatic valve 136 (see FIG. 14 below). Such automatic valves are known in the mechanical arts and, therefore, are not discussed in further detail here. As will be apparent from the description of operation below, such a valve is required to release the vacuum pressure in order to sequentially move new material 20 into the cutting assembly 100 and move the band and containers 16 out of the apparatus 10. Otherwise, the force exerted over the band surface would make it impossible to move the containers.

Returning now to FIG. 1, the containers 16 are shown resting on the transport apparatus 20, with one or more being surrounded by a band 12. While it is very desirable to have each band 12 expand open to accept a container 16, it is not desirable for the banding material 20 to open until cut into discrete bands. Therefore, a retaining or retention rod, bar, or clip is positioned adjacent to the support head 130 to prevent the material 20 from opening until the blade 102 has finished its cut. This provides a more uniform cut and improves control over deposition of the bands 12.

As shown in FIG. 1, the retention means can use a bar or rod 140 to restrain opening of the bands 12. The retention rod or bar 140 comprises a thin bar or small rod of material which extends approximately perpendicular to the travel path of the banding material 20 and is also approximately parallel to the edge of the shear plate 110. The rod 140 is suspended next to the banding material 20 as it extends down from the cut-off or blade assembly 100 so that it presses against the banding material to force it to stay collapsed while being cut.

Figure 10:
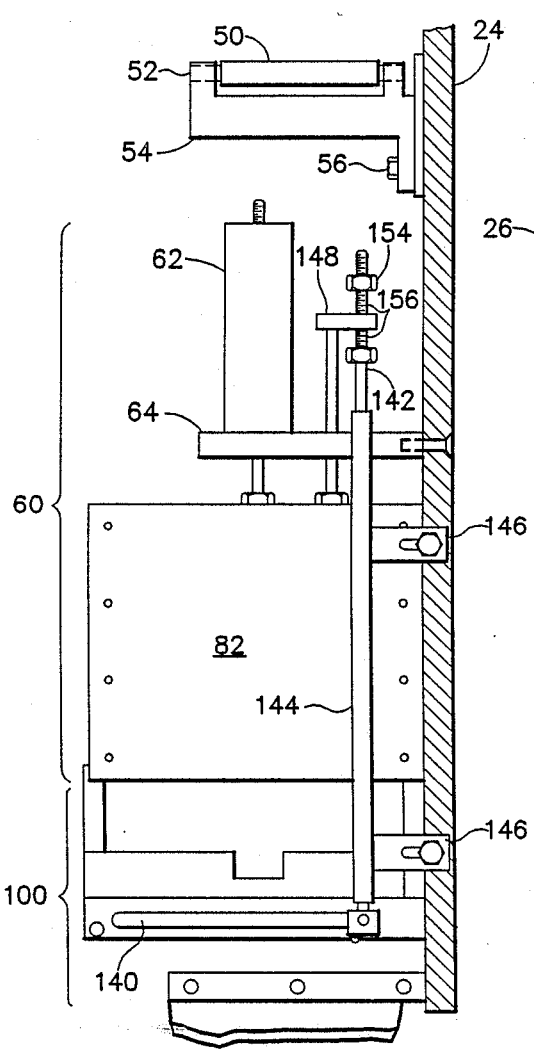
FIG. 10 is a side elevation view taken on line 10—10 of FIG. 1 with the separation wedge and banding material removed.
Figure 11:
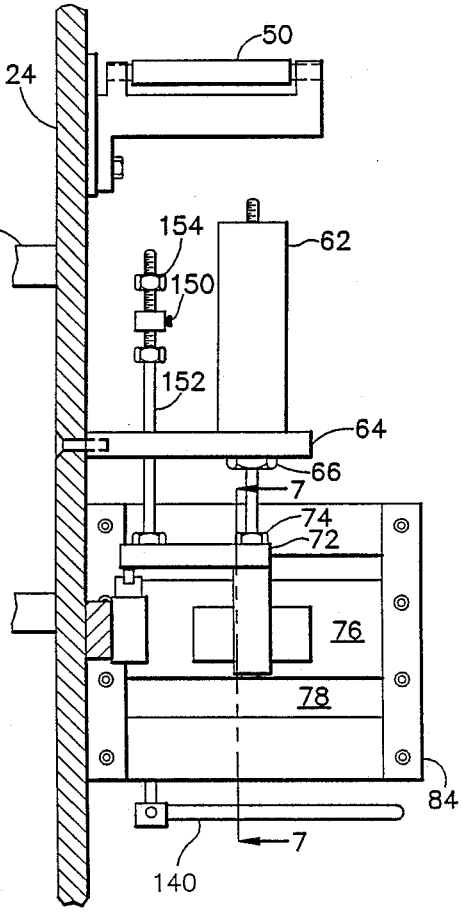
FIG. 11 is a side elevation view taken from the opposite side of the view of FIG. 10.

As better seen in FIGS. 10 and 11, the retainer rod 140 is suspended, using one cf a variety of connectors or set screws, from the lower end of a vertical support rod 142 which extends vertically behind the slide support plate 82. The rod 142 can be made from a variety of rod or tubular materials such as lightweight aluminum or stainless steel. In the preferred embodiment, the rod 142 reciprocates within a guide tube 144 which maintains control over the alignment of the rod to assure proper operation. The guide tube 144 is in turn secured to the back or support wall 24 using a series of brackets 146. The guide tube 142 typically comprises a lightweight metallic or plastic material.

The upper end of the rod 142 extends above the plates 82 and 64. A connecting bracket 148 is attached to the top end of the rod 142 such as by a set screw 150. This plate extends between the rod 142 and a position above the plate 64. Here a second vertical or control rod 152 is connected between the plate 72 and the bracket 146. This connection means that as the drive bracket 70 is raised and lowered during the advancement of the banding material 20, the rod 150 will raise and lower and so will the rod 142.

Therefore, as new material is advanced by the feed mechanism 60 into the cut-off assembly 100, the retainer rod 140 descends with the material 20 to maintain a closed tubing structure adjacent to the blade 102 and shear plate 110. Once the blade 102 has cut a band from the end of the material 20, the feed mechanism 60 raises the bracket 70 and, therefore, the plate 72 so the retainer rod 140 is also raised and the newly cut band 12 allowed to open.

To provide accurate vertical adjustment or positioning of the rod 142 and retaining bar 140 a pair of adjustment nuts 154 are employed on the top end of the rod 142 on either side of the support bracket 148. To allow for flexible biasing a spring 156 is disposed between the bracket 148 and the nuts 154.

Figure 12:
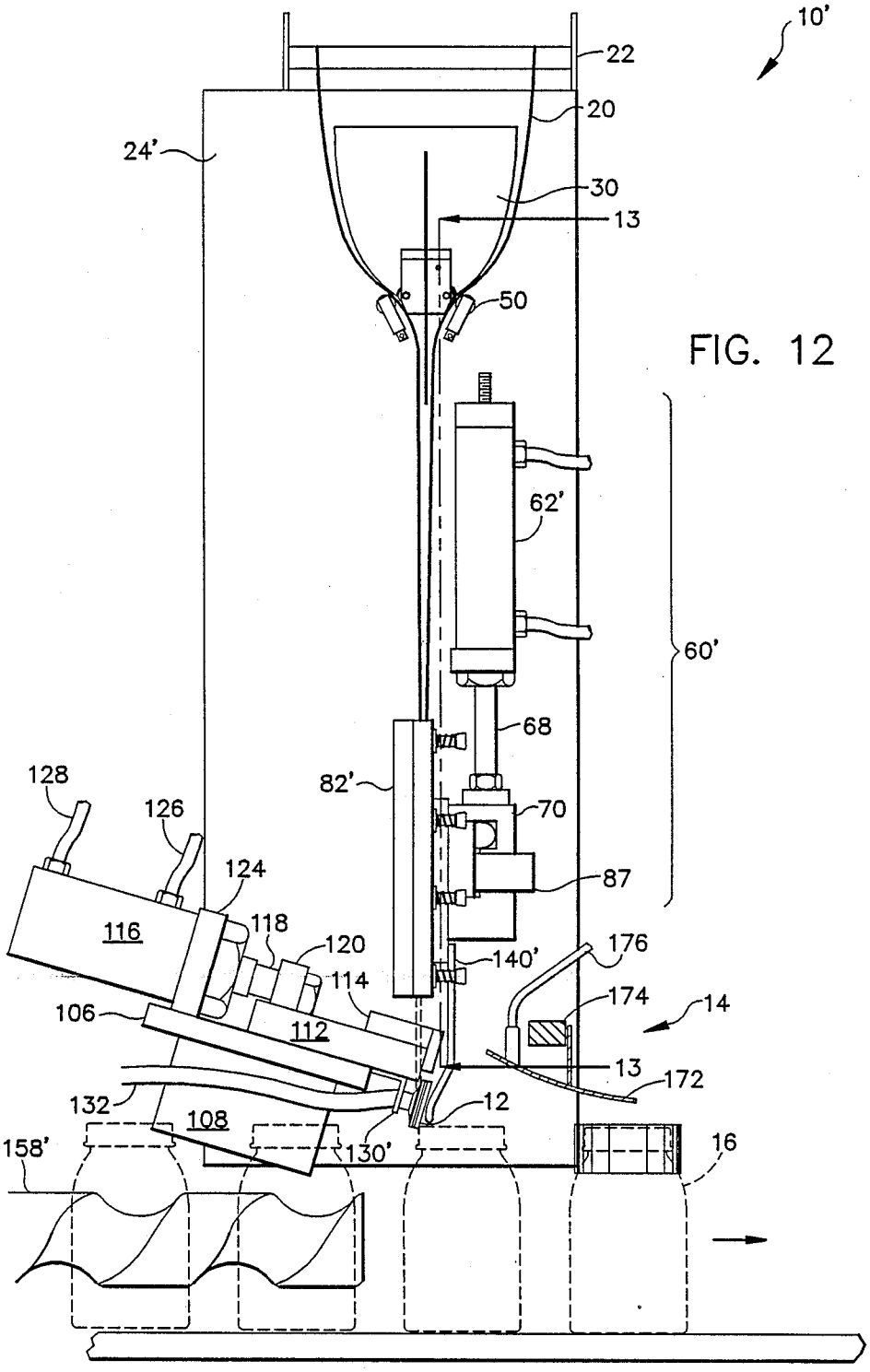
FIG. 12 illustrates a front elevation view of a large container bander employing an alternative band retention device and feed assembly configuration.
Figure 13:
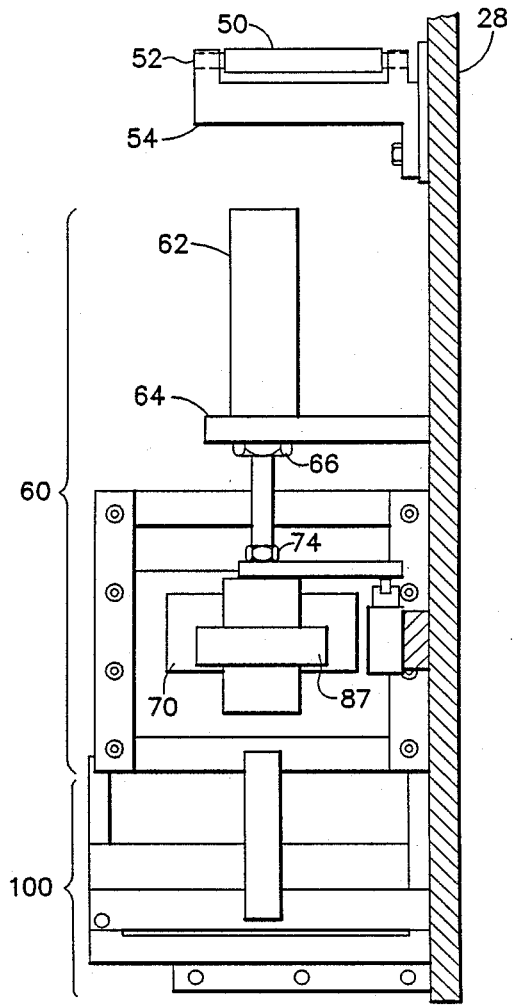
FIG. 13 is a side elevation view taken on line 13—13 of FIG. 12 with the separation wedge and banding material removed.

An alternate, and more preferred, retention means is illustrated in FIGS. 12 and 13 where a banding apparatus 10' is shown using an altered configuration for the feed assembly. In FIG. 12, a feed assembly 60' is employed, which comprises the same components as the feed assembly 60 described above, but constructed with the feed cylinder 62, piston 68, bracket 70 and associated parts mounted on the opposite side of the banding material 20. This allows a reduction in the complexity of the retention means by not requiring special rods and plates to extend over the plate 82 to reach vertically reciprocating components in the feed assembly.

Using the configuration of FIG. 12, the retention means comprises an elongated retention clip 140' secured on an upper end to the slide plate 76 or pivot block 86. The retention clip typically comprises a piece of thin stainless steel which has been biased to curl or curve toward the banding material 20 when mounted in place. The clip can be secured in place using means such as small bolts or screws. The retention clip extends vertically downward toward the suspension means and is positioned substantially parallel to the banding material 20. The lower end of the retention clip curves toward the banding material and contacts the banding material on an opposite side from the suspension means when the feed assembly 60' or the slide plate 76 is in a downward stroke position. When the feed assembly 60' moves to an upward stroke position, and thus the plate 76 moves upward, the retention clip 140' also moves upward so that the bottom portion of the retention clip engages the cut-off assembly 100 or the shear plate 112 above the banding material when the slide assembly. Therefore the retention clip 140' is raised or lowered in coordination with the upward and downward strokes respectively of the slide assembly and each time it is raised a newly formed band 12 is allowed to open.

The retainer clip 140' can be made from several materials such as spring biased stainless steel. In addition, the bottom of the retainer clip 140' is generally curved outward from the contact surface with the bands 12 or banding material 20 and polished or sanded smooth so that it does not catch on the material when first sliding over the material surface.

Positioned next to the cut-off assembly 100 is a guide shield 72 mounted on a support post 174. The shield 172 comprises a thin curved metal sheet which assures that once the retainer clip 140' or retention bar 140 move upward and the band 12 opens, it is directed downward over the containers 16 and does not rise up over edges of the container top. The shield 172 can also provide a platform for supporting a detector 176 which is typically an electric eye type device mounted above a small aperture in the shield. In the alternative, a micro switch or electric eye detector is mounted next to the transport mechanism 18 under the mounting station 14 to detect containers positioned under the suspension or support head 130. The detector 176 operates in conjunction with a valve 186 described below.

As discussed above, a container transport system 18 sequentially advances containers 16 to the band mounting station 14. The containers are supplied to and moved away from the apparatus 10 using any suitable means. A supply or conveyer belt is shown for purposes of illustration, being movable in the direction indicated by the arrows. The belt brings capped containers into engagement with the apparatus 10 and moves sealed containers away from the apparatus 10. The transport system 18 is mounted in any suitable manner beneath portions of the banding apparatus 10.

However, the timing and coordination of containers with the formation of bands is sensitive to the transport speed and motion of the containers 16. To more precisely control this passage of containers 16 and to assure an even disposition of one container per band per rate of band formation, and space the containers apart accordingly, a feed screw mechanism 158 is often employed along the conveyer 18. In the alternative, one or more stop pins, gates, arms, or pistons could be employed to extend across the conveyer 18 to alternately stop and start containers 16 at periodic intervals along the belt or a precision control is used on the transport system 18 motor or drive unit.

The screw mechanism 158 need not extend into the band mounting station 14 as shown in FIG. 1, but can be terminated earlier as shown in FIG. 12. Once the screw 158 has set or adjusted the spacing of the containers 16 in a few turns the transport system 18 can provide the remaining container movement unimpeded.

The screw 158 typically comprises a cylindrical material which has been turned to achieve a desired pitch or thread pattern. To assure efficient transfer of the containers 16, the exterior of the screw 158 should be coated with a low friction material. Alternatively, the screw is made entirely of a low friction plastic or organic material such as tetraflourohydrocarbon. The screw 158 is mounted on a frame or housing extension used for the construction of the bander 10. The screw 158 is typically connected to an electric motor 160 (not shown in FIG. 1) through a flexible coupling shaft 162. The entire transport system 18 and the screw 158 are supported and partially enclosed by a support housing which also serves as a mounting platform for other elements used for the bander 10

The containers travel along the system 18 to a staging area or position at the end of the screw 158 where they collect until moved forward by the feed screw 158. A pressure sensitive switch or optical detector 164 can be used to determined that more than one container is present in the staging area. This is done to assure that an even stream of containers 16 is available. Otherwise, a single container represents an aberration which is inefficient for the bander 10 to operate on. Also a lack of multiple containers suggests a fault with earlier processing stages and continued operation of the bander 10 is suspended until containers are available.

Containers are pushed or moved along the central portion of the transport system or conveyer 18 under the mounting station 14 by turning the feed screw 158 at a predetermined rate. The turning rate of the screw 158 is determined by the rate at which the bands 12 are delivered to their mounting position above the conveyer 18. The screw is configured to have a pitch and radial dimensions to match the exterior cross section or perimeter dimensions of the containers being banded.

After banding the containers 16 move along the transport system 18 to a heat tunnel or similar heat source where the thermoplastic material of the band 12 is exposed to the required heat for a short period and shrinks to fit snugly around the containers 16.

Figure 14:
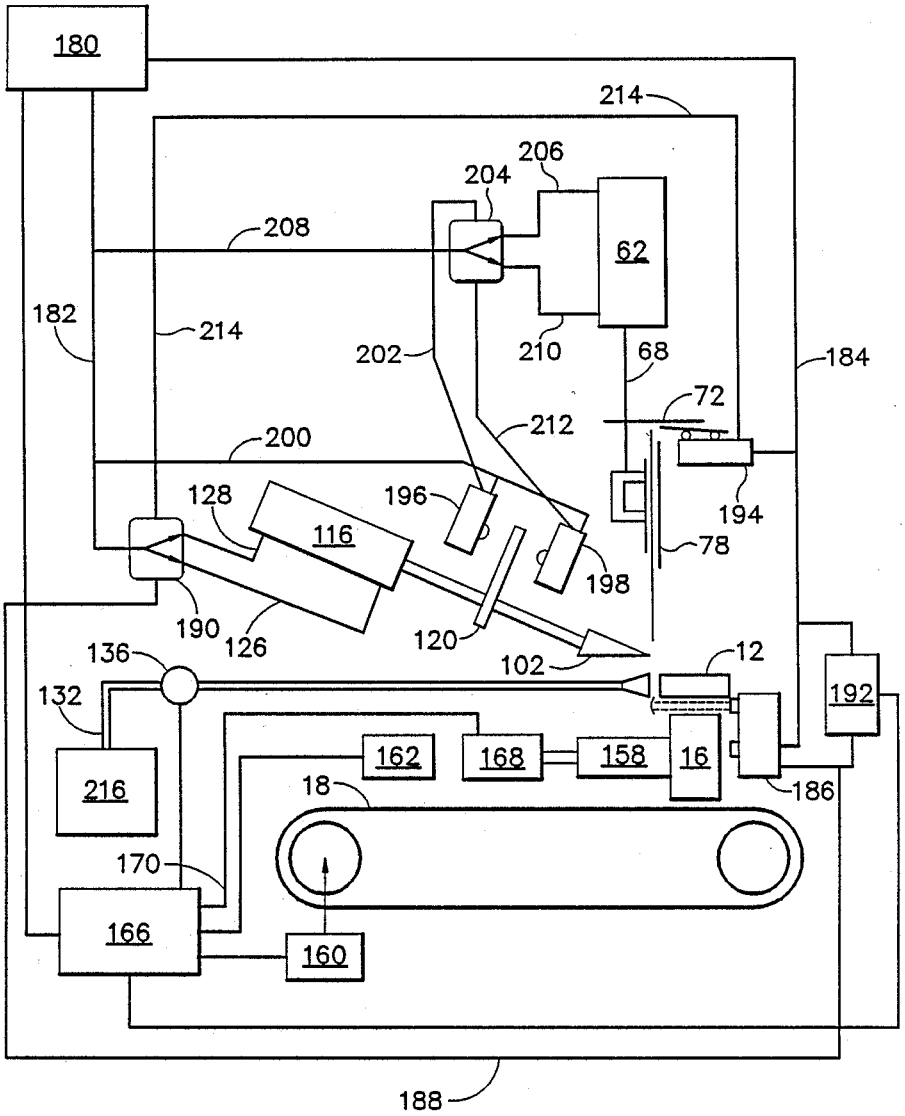
FIG. 14 is a schematic diagram of the interconnection of the elements of FIGS. 1–13.

FIG. 14 is a schematic representation of the control and operation of the large size container bander 10 illustrated in the detail views of FIGS. 1–13. In FIG. 14, a controller 166 controls the actuation of electrically and pneumatically operated devices and drivers throughout the bander 10 as well as the interaction of various sensors used to operate certain functions. The controller 166 can comprise one of several devices such as electrical or mechanical timers and control panels. The preferred embodiment employs a series of switches which activate or control the position of electrically operated valves which activate various pressure lines.

As shown in FIG. 14, the controller 166 controls the passage of containers 16 into the banding apparatus 10 on the conveyer 18. This is accomplished by activating or controlling a transport driver or motor 168 through a control line 170. The speed of the motor 168 is adjustable to affect specific feed rates for a variety of container types and sizes. An external speed control such as a varactor or a potentiometer can be connected to the controller 166, or motor 168, to manually adjust the feed rate of the containers 16 as desired. Such a manual control can be mounted on a control panel (not shown) and connected to the controller for varying control parameters during operation of the banding apparatus 10.

As the containers are moved along the conveyer 18 the detector or a pressure sensitive switch mechanism 164 determines the presence of two, or more containers to be banded. Once the requisite number of containers are present on the conveyer, the screw driver is activated by a signal on the control line 170.

On start-up of the apparatus 10 (screw 158), line pressure from a suitable compressed air source 180 is applied on a pressure line 184 to a supply valve 186 which is engaged, manually or automatically to allow the passage of compressed air. The type of valve mechanism is not important to the present invention. It may be a mechanical valve operated by contact with a container 16 or indirectly operated through engagement of the associated electrical detector and switch 176, as will be apparent to those skilled in the art.

If the valve 186 is engaged by a container 16 located at the band mounting position 14, then line pressure passes through the valve 186 and is applied through line 188 to a shuttle of a valve 190. In the alternative, in the absence of container engagement of the valve 186, line pressure to the valve 190 is supplied by manually or electrically actuating a start valve device 192, which is connected in parallel with the line 188.

Whether applied by the action of the valve 184 or valve device 192, the pressure delivered to the shuttle valve 190 is "pilot" pressure, which operates or moves an internal valve shuttle between two alternating positions. Air pressure is routed between the main air pressure line 182 and either side of the cylinder 116. Therefore, depending upon which line the pilot pressure is supplied through (126, 128), determines which end of the cylinder 116 is pressurized. At the same time, pressure is also applied to a valve 194 through pressure line 184, and valves 196 and 198 through a line 200.

In this configuration, pilot pressure on the line 188 acts upon the shuttle of the valve 190, adjusting the shuttle to direct pressurized air from the line 182 through the line 126 which is connected to a lower portion of the cut-off cylinder 116. This causes cut-off blade 102 to move in an upward or lateral retraction stroke away from the banding material 20. The movement of the blade 102 continues until bracket 120 engages and opens the valve 196. This allows pressure to pass from the lines 182, 200 through the valve 198 to a pilot line 202.

Pressure on the pilot line 202 is applied to a shuttle of a valve 204. The pressure on the line 202 moves the shuttle so that line pressure from a line 208 is applied to a line 206 on the top of the feed cylinder 62. This application of pressure causes the piston rod 68 to move or extend downward, also causing the feed assembly 60 to engage and advance the banding material 20.

As the piston rod 68 advances in a downward stroke the contact plate 72 actuates the valve 194 which transfers pressure from the line 184 to a pilot pressure line 214. This transfers pressure to an opposite side of the shuttle of the valve 190 which redirects the shuttle valve output pressure to the pressure line 128. This applies pressure to the upper portion of the cut-off cylinder 116 and causes cut-off blade 102 to move in a downward and lateral cutting stroke which cuts a band 12 from the banding material 20. The movement of the blade 102 continues until bracket 120 engages and opens the valve 198. This allows pressure to pass from the lines 182, 200 through the valve 198 to a pilot line 212.

Pressure on the pilot line 212 is applied to the valve 204 shuttle which redirects its output pressure to a pressure line 210 and the bottom of the feed cylinder 62. This application of pressure causes the piston rod 68 to move or retract upward, also causing the feed assembly 60 to disengage the banding material 20.

Each time the blade 102 completes a cut off or extension stroke, the actuation of the valve 198 causes the piston rod 118 to be retracted upward. Conversely, each time the blade 102 completes a retraction stroke, the actuation of the limit switch 196 causes the piston rod 118 to be extended downward in a feed stroke. Each time the piston 68 extends the drive bracket 70 downward and new banding material 20 is advanced in the feed assembly 60, the plate 72 contacts the pilot valve or switch 184 which causes the piston rod 118 and the blade 102 to be extended. Therefore, once the requisite number of containers are detected on the transport system 18 the forming of bands 12 is automatically executed. As long as new containers are provided or present in the apparatus 10, the switch 186, or automatic switching device 192, provides pressure to the valve 190 which causes the entire cycle to repeat.

At the same time, the valve 136 is opened automatically, connecting the exit tube 132 to a source of vacuum or negative pressure 216 to the support head 130 each time the feed piston rod 68 completes a downward feed stroke. This activation of the valve 136 can be tied to the valve 194 or a separate switch. As the containers 16 are positioned within each newly formed band 12 the valve 136 is closed, releasing suction on the band which then falls loosely around the containers. As the valve closes, the loosely banded containers are transferred onward by the conveyer 18.

While the transport system 18, as described above, in combination with the screw 158, works to advantage for many large size containers, one problem is encountered in certain applications. The above described embodiments fail to properly or completely align and support large scale bands for use on containers having a larger top, mouth, or lid portion than the remainder of the container. However, containers of this general construction or category find extensive use for many perishable food products or spreadable goods, including margarine, dips, yogurt, toppings, salads, ice cream, and cottage cheese. There is increasing interest in providing a tamper resistant seal and redundant back up to product spillage for this type of container. Therefore, there is an increasing interest and need to have a method and apparatus to provide a sealing action for this type of container.

An exemplary container is the snap top or resealable lid type containers, also known as tubs, used for many dairy related products. This type of removable lid container is typically on the order of 3 to 5 inches in diameter and has a lid with a diameter slightly larger than the remainder of the container and has an outer lip that projects laterally beyond the sides of the container and interacts with a ridge or channel in the lid to hold it in place. This type of container is provided in a variety of sizes ranging from 1 to 6 or more inches in height.

Unlike the traditional bottle shape, these containers do not have a lower body portion which can support a band 12 prior to heat treatment. Since the bands must be made sufficiently loose to fit over the lid, they are much wider than the main body of the container and drop completely over the container and onto the conveyer belt. In order to provide a seal for the container lid a much taller, whole container, band is required which is very inefficient and costly. Even if the bands initially are aligned with the top portion of the container, they tend to move during transport and initial heat shrinkage. What is needed is a method and apparatus for depositing bands to large scale containers having a wider top or lid than main body which eliminates these complications.

A new method and apparatus for applying large circumference bands to snap lid containers is illustrated in FIG. 15. In FIG. 15, the conveyer belt 220 is illustrated carrying a series of snap top or lid type containers 226 to or from a band mounting station 224. The conveyer 220 moves or transports the containers 226 from locations outside of the banding apparatus 10" such as from another conveyer belt, through the banding apparatus 10" and into the heat tunnel 228 and then out of the apparatus 10".

As will be apparent to those skilled in the art from the disclosure that that follows, the preferred method of moving containers 226 onto the conveyer belt 220 is through the use of one or more conveyer belt type transfer systems which move the containers 226 in a direction substantially perpendicular to the path of the conveyer belt 220. This allows the containers to be inserted and removed from in-between a series of deflection and support plates described below. However, other apparatus can be constructed to place and remove containers 226 from a direction parallel to the length of the conveyer 220 where desired.

The conveyer belt 220 generally comprises a multi-segmented plastic or metal conveyer belt which consists of a series of interlocking plates which are typically one to two inches long and three to six inches wide. While the present invention can also be utilized with continuous fabric or reinforced rubber or chain belt structures, solid plate structures are preferred for improved container support and material handling capabilities. The dimensions illustrated in FIG. 15 for the conveyer 220 and the drive elements 228 are illustrative only and would vary according to the specific application as will be apparent to those skilled in the art.

As shown in FIG. 15, a series of support and deflection platforms or plates 230 are shown mounted along the length of the belt 220. The deflection plates 230 are spaced apart along the belt so as to provide room for the containers 226 between adjacent plates. For a typical container top diameter on the order of 4.5 to 5.5 inches, the plate 230 separation is on the order of 4.0 to 4.75 to place the plates about 0.375 to 0.625 inches below the top of the containers. However, the plates 230 are not pressed tightly against opposite sides of the containers but allow freedom of lateral motion when desired.

The deflection and support plates 230 are constructed of a thin metal sheet or plate material capable of handling high temperature heat in excess of 300 degrees Fahrenheit Exemplary materials are 20 to 18 gauge or 0.03 to 0.70 inches thick stainless steel, aluminum, copper, or brass with stainless steel being preferred for use around foodstuffs in accordance with Federal Drug Administration rules and requirements.

The plates 230 are generally made the full width of the conveyer belt 220 in order to assure proper guidance of the containers 226 between adjacent plates and non-catching support of bands or whenever a lateral feed belt arrangement is used as previously discussed. However, the plates 230 can be also made wider than the belt 220 to prevent catching band edges and to adequately support bands. An exemplary length for the plates 230 is on the order of 2 to 3 inches or move in order to function as a heat deflector, and adequately distribute heat and forced hot air as described below.

Each plate 230 is secured to the belt 220 using at least one, but preferably two or more, vertical posts or rods 232 which are secured to the underside of the deflector plates 230 by spot welding, adhesives, bolts or similar fastening means and project down into support tubes 234. Using countersunk screws into the ends of the posts 232 or a threaded end section mating to a threaded hole in the plates 230 allows course height adjustment without multiple plates 230. However, a strong, fixed attachment of the plates 230 is required and more permanent fastening techniques are typically used.

The posts 232 typically comprise a small rod or cylinder made from material such as, but not limited to, stainless steel, steel, aluminum, copper, brass, or high temperature plastic, with stainless steel again being preferred. The posts 232 are capable of withstanding high temperatures in excess of 300° Fahrenheit as disclosed below.

The support tubes 234 are typically hollow metal cylinders or tubing which are secured at the base to a conveyer 220 top surface 238 by a bolt or similar fastener extending through the belt 220, although other fastening techniques can be employed. The support tubes 234 are made from the same types of materials comprising the vertical support rods 232. One or more set screws 236 are inserted through one side of the support tubes 234 and tightened against each rod 232 to secure each deflection plate 230 at a desired height.

The height that a deflection plate 230 is adjusted to depends on the dimensions of the specific containers 226 being employed, as well as, the lateral dimensions of the deflection plate 230. Since most, but not all, of the containers of interest have sloped sidewalls, the separation distance of the plates 230 depends on the exact vertical height at which the plates are set, which will be apparent to those skilled in the art. The plates 230 are generally separated a coarse distance determined by the range of maximum container 226 diameters expected for the banding apparatus 10". The vertical height of the plates 230 are then adjusted to accommodate specific diameters or widths within the chosen range. Occasionally the plates 230 are interchanged with other widths to facilitate adjustment outside of the original range.

As previously discussed, it is intended to have the banding apparatus 10" accommodate a variety of containers or container dimensions ranging from as short as 1 to 1 ½ inches up to 6 to 8 inches in height, and at the same time, varying from 3 to 5.5 inches in width. These variations are accommodated by varying the plate 230 height by adjusting or replacing the posts 232. That is, for a standard width or diameter but varying heights the plates 230 may be adjusted vertically in order to fit under the lip of the target container while supporting a band 12 adjacent to that lip. For this reason, the tubes 234 are typically made on the order of 0.50 to 1 inch tall in order to accommodate very short containers. At the same time, the posts 234 can be made arbitrarily long in order to accommodate the tallest containers 226. In addition, when containers progress in height they often change in width requiring a narrower or wider plate 230. To this end, the apparatus 10" typically has a series of plates 230 associated with it which are changed depending upon the particular size or dimensions used for the target containers 226.

In order to have the band 12 properly seat on the containers 226 and not slide off or become otherwise deflected before heat treatment, a special preheating stage is implemented immediately adjacent to the cut off assembly 100. In this pre-heat treatment a source of hot air, such as, but not limited to, an electric heat gun 240, is positioned immediately above the path of the containers 226 on a support plate 242 and other support brackets where desired. The plate 242 comprises a material resistant to the high temperature output of the heat source 240 and has a generally cylindrical opening 244 or passage extending through it, although other geometries may be employed. The opening 244, is positioned approximately centered above the conveyer 220 or along the center line of the moving containers. The heat source 240 projects a stream of heated air 246 downward through the opening or aperture 244 onto either the plates 230 or the containers 226 as the conveyer 220 moves past. The air stream 246 has a temperature on the order of 300 degrees Fahrenheit but is adjusted to meet the requirements for the particular banding material 20 and containers 226. The heat source 240 can be controlled by the system controller 166, discussed earlier, to reduce operating time when no containers are present.

In the configuration of FIGS. 15 to 17, a band 12 is formed and disposed around the upper or lid portion of a container 226 where it rests on a lower edge 248 on top of two adjacent deflection and support plates 230. The plates 230 on each side of a container 226 support each band vertically in a preselected position adjacent or over the lip or lid edge as the containers receive bands and are moved toward a heat tunnel or shrinking station (not shown).

The hot air stream 246 first encounters a plate 230 on the leading side of the container 226 where it is deflected sideways or laterally into the container and the band 12. This sideways flow of air naturally causes the band 12 to contract about the container. However, due to the reasonably fast motion of the conveyer 220, as well as the limited coverage of the narrow hot air stream 246, only a small portion of the band 12 contracts around the edge of the lip or top of the container 226.

As the conveyer 220 continues to move the container under the heat source 240, the trailing edge of the container 226 is heated, along with the leading edge of the next container. This results in a leading and trailing edge of the container having a band 12 partially contracted around the container. This automatically secures the band 12 in place and prevents further slippage along the top of the container so that the band is properly positioned for heat treatment. It is preferred that a heat tunnel be positioned over the exit portion of the conveyer 220 but with the bands 12 thus secured in place, the heat tunnel can be at a further remote location.

Therefore, containers having a wider top than main body or even uniform dimensions are easily accommodated in the banding apparatus 10''. In addition, the deflection and support plates 230 provide an efficient means of guiding containers 226 into place using a lateral feeding system. This allows a production line to have a "folded" path and use space more efficiently.

What has been described then is a new banding apparatus for containers or similar objects having a large peripheral measure. The apparatus automatically forms and deposits large sized bands with improved efficiency.

The foregoing description of preferred embodiments has been presented for purposes of illustration and description. It is not intended to be exhaustive nor to limit the invention to the precise forms disclosed, and many modifications and variations are possible in light of the above teaching. The embodiments were chosen and described to best explain the principles of the invention and its practical application to thereby enable others skilled in the art to best utilize the invention in various embodiments and with various modifications as are suited to the. particular use contemplated. It is intended that the scope of the invention be defined by the claims and their equivalents.

What I claim as my invention is:

1. A banding apparatus for automatically applying a band to large objects or containers, comprising:

forming means for receiving and for opening flattened tubular banding material of a predetermined diameter, said material having a sidewall with a circumference larger than a perimeter length around individual containers, and for pressing out creases in said sidewall;

feed means for advancing predetermined lengths of said banding material from said forming means to a position vertically adjacent said containers;

cut-off means for receiving and cutting said predetermined lengths of banding material so as to form separate bands of predetermined height; and suspension means positioned adjacent to said forming means for receiving said bands and for engaging and holding one side portion only of said bands in a fixed vertical position above the containers with the opposite side portion tilting downwardly in an open configuration for engagement by said containers.

2. The banding apparatus of claim 1 wherein said forming means comprises:

an input guide comprising a guide roller mounted transverse to a path of travel for said banding material;

at least two spaced apart outer pinch rollers, each rotatably mounted on a support bracket adjacent to opposing sides of said path, said outer pinch rollers positioned to rotate against said material; and a floating wedge, said wedge being wider than the space between said outer pinch rollers and being disposed within said tubular banding material, said wedge having at least two inner pinch rollers rotatably mounted thereon and positioned for rotatably engaging interior surfaces of said banding material, said wedge further positioned with said inner rollers immediately adjacent said outer rollers so as to flatten creases in-between.

3. The banding apparatus of claim 2 wherein said floating wedge further comprises:

first and second substantially flat separation plates, each separation plate having a narrow end and a wide end with a central axis extending therebetween;

said plates being joined together at their narrow ends along their respective central axis so as to reside in substantially perpendicular planes and joined so that the narrow end of said first plate overlaps the narrow end of said second plate by a predetermined distance; and at least two inner crease rollers disposed adjacent the narrow end of one of said plates with one roller along each outer edge of said plate.

4. The banding apparatus of claim 3 wherein said wedge further comprises a rectangular support block having first and second substantially parallel faces and four sides with a central slot disposed between said faces, said slot fitting over the narrow end of said plate holding said inner crease rollers and being wider than said plate is thick, said inner crease rollers being further mounted within depressions on the sides of said support block.

5. The banding apparatus of claim 3 wherein said plates have a substantially parabolic shape.

6. The banding apparatus of claim 3 wherein said plates have a triangular shape.

7. The banding apparatus of claim 3 wherein said plates have a widest dimension on the order of one half a perimeter of desired bands.

8. The banding apparatus of claim 2 where said floating wedge further comprises a tetrahedron block with at least two inner crease rollers disposed two opposing faces of said block adjacent an apex thereof.

9. The banding apparatus of claim 1, wherein said feed means comprises:

a slide assembly mounted in said travel path for said banding material being movable vertically parallel to said path in downward and upward feed strokes, said slide assembly having slot for passage of said banding material;

a piston rod configured to engage said slide assembly on one end and provide reciprocating vertical movement thereof;

a cylinder connected to a second end of said piston rod for actuation thereof; and a contact lever pivotally mounted on said slide assembly, said contact lever comprising an inverted L shaped lever having a vertical arm and an horizontal arm and being mounted so as to pivot about the intersection the two arms with the vertical arm extending through a slot in said assembly for contacting said banding material and a horizontal arm extending away from said banding material, said horizontal arm being positioned for releasable engagement by said piston whereby said contact lever achieves releasable clamping engagement of said banding material on each downward stroke for moving said banding material through said feed means and substantial nonclamping engagement on each upward stroke.

10. The banding apparatus of claim 9, wherein said said cylinder and piston rod are located on an opposite side of said banding material from said cut-off means.

11. The banding apparatus of claim 9, wherein said feed means further comprises:

a C shaped drive bracket secured to said piston rod, said drive bracket configured to engage said slide assembly above and below said horizontal lever and to releasably engage said lever on downward strokes.

12. The banding apparatus of claim 1, wherein said cut-off means comprises:

a blade assembly disposed across said travel path at a downward angle so that a cut-off blade slidably mounted therein engages said banding material at an angle against a shear stop plate as the blade traverses said path; and an input plate secured to a top portion of said blade assembly with a guide slot disposed in said plate and positioned transverse to said travel path so as to guide said banding material into said blade assembly.

13. The banding apparatus of claim 1, wherein said suspension means comprises a support head mounted adjacent an output of said cut-off means so as to be immediately adjacent said banding material while it is being cut into newly formed bands, said support head being configured as a flared nozzle coupled through hollow tubing to a source of negative pressure.

14. The banding apparatus of claim 13 wherein said nozzle has dimensions on the order of 1.0 inch in diameter at its widest.

15. The banding apparatus of claim 13 wherein said nozzle is secured to a support bracket mounted to an underside surface of said blade assembly adjacent the travel path for said banding material.

16. A banding apparatus for automatically applying a band to large objects or containers, comprising forming means for receiving and for opening flattened tubular banding material of a predetermined diameter, said material having a sidewall with a circumference larger than a perimeter length around individual containers, and for pressing out creases in said sidewall;

feed means for advancing predetermining lengths of said banding material from said forming means to a position vertically adjacent said containers;

cut-off means for receiving and cutting said predetermined lengths of banding material so as to form separate bands of predetermined height;

suspension means positioned adjacent to said forming means for receiving said bands and for engaging and holding a portion of said bands in a fixed vertical position above the containers, suspending them in an open configuration for engagement by said containers; and retention means for releasably holding said banding material in a collapsed state adjacent said suspension means, said retention means mounted on an opposing side of said banding material from said suspension means, and being vertically movable between an engaged position adjacent said suspension means so as to hold banding material in a collapsed state against said suspension means and a retracted position above both said suspension means and said bands, whereby each of said the bands open adjacent an upper portion of a container for engaging said container.

17. The banding apparatus of claim 16, wherein said retention means comprises an elongated retention clip mounted on an upper end to said slide assembly and extending downward substantially parallel to said banding material, said retention clip having a lower end biased to engage said banding material when said slide assembly is in a down stroke position and to disengage from said banding material when said slide assembly moves upward to an up stroke position.

18. The banding apparatus of claim 17, wherein said retention clip comprises a thin rectangular plate of material which is springingly biased on said lower end to deflect towards said banding material.

19. The banding apparatus of claim 16, wherein said retention means comprises:

a retention bar having a longitudinal axis positioned substantially perpendicular to said travel path; and vertical driver means connected to said retention bar for raising or lowering said retention bar in coordination with the upward and downward strokes respectively of said feed means.

20. The banding apparatus of claim 19, wherein said vertical driver means comprises:

a first vertical rod connected to said retention bar and extending upward toward said feed means;

a second vertical rod coupled to said feed means piston rod; and a horizontal bracket connected between upper ends of said vertical rods.

21. The banding apparatus of claim 20, further comprising:

a vertical cylindrical guide disposed about a portion of said first vertical rod and extending upward toward said feed means, being mounted on said banding apparatus; and a second horizontal bracket connected between said second vertical rod and said feed means piston rod.

22. The banding apparatus of claim 1 further comprising alignment means for positioning each successive ones of said containers within a volume encompassed by a suspended band.

23. The banding apparatus of claim 1, further comprising transport means for moving said objects into and out of said banding apparatus, said suspension means comprising means for suspending said bands from a side portion closest to the incoming objects and above the top of said objects with the opposite side portion tilting downwardly to a position below the top of said incoming objects for engagement by said objects to expand the bands around said objects.

24. The apparatus as claimed in claim 1, further including deflector means for urging said opposite side portions of said bands downwardly into the path of an object in said apparatus.

25. A banding apparatus for automatically applying a band to the neck of large objects or containers, comprising:

forming means for receiving and for opening flattened tubular banding material of a predetermined diameter, said material having a sidewall with a circumference larger than a perimeter length around individual containers, and for pressing out creases in said sidewall;

feed means for advancing predetermined lengths of said banding material from said forming means to a position vertically adjacent said containers;

cut-off means for receiving and cutting said predetermined lengths of banding material so as to form separate bands of predetermined height; and suspension means positioned adjacent to said forming means for receiving said bands and for engaging and holding one side portion only of said bands in a fixed vertical position above the containers with the opposite side portion tilting downwardly in an open configuration for engagement by said containers; and transport means for moving containers into and out of said banding apparatus, said transport means including support means adjacent opposite side edges of each transported container and below the top of a container for supporting the lower edge of a band engaged on the container.

26. The apparatus as claimed in claim 25, further including heating means for heating said bands after engagement by said containers to shrink said bands to fit said container necks.

* * * * *